US008556397B2

(12) United States Patent
Rittgers et al.

(10) Patent No.: US 8,556,397 B2
(45) Date of Patent: Oct. 15, 2013

(54) INK CONTAINER TO SEPARATE UNWANTED PARTICLES FROM INK

(75) Inventors: Jon Rittgers, Kildare (IE); Odhran Hendley, Kildare (IE); Mark Laughlin, Wexford (IE); Eduardo Macias, Clonee Meath (IE); Michael Mulloy, Dublin (IE); Bryan Murphy, Dublin (IE)

(73) Assignee: Hewlett-Packard Development Company, L. P., Houston, TX (US)

( * ) Notice: Subject to any disclaimer, the term of this patent is extended or adjusted under 35 U.S.C. 154(b) by 126 days.

(21) Appl. No.: 13/259,690

(22) PCT Filed: Dec. 15, 2009

(86) PCT No.: PCT/US2009/068074

§ 371 (c)(1),
(2), (4) Date: Sep. 23, 2011

(87) PCT Pub. No.: WO2011/075118

PCT Pub. Date: Jun. 23, 2011

(65) Prior Publication Data

US 2012/0013688 A1 Jan. 19, 2012

(51) Int. Cl.
*B41J 2/175* (2006.01)
*B41J 2/17* (2006.01)

(52) U.S. Cl.
USPC ..... 347/86; 347/84; 347/93

(58) Field of Classification Search
USPC ..... 347/84, 85, 86, 93
See application file for complete search history.

(56) References Cited

U.S. PATENT DOCUMENTS

| | | | | |
|---|---|---|---|---|
| 3,550,792 | A | 12/1970 | Stowell | |
| 4,428,665 | A | 1/1984 | Hays | |
| 6,199,979 | B1 | 3/2001 | Hobson et al. | |
| 2006/0066698 | A1 * | 3/2006 | Takatsuka | 347/93 |
| 2008/0218552 | A1 | 9/2008 | Xu et al. | |
| 2009/0021567 | A1 | 1/2009 | Gao et al. | |

FOREIGN PATENT DOCUMENTS

JP 08-252924 A 10/1996

OTHER PUBLICATIONS

International Search Report and Written Opinion received in PCT Application No. PCT/US2009/068074, mailed Sep. 10, 2010, pp. 8.

* cited by examiner

*Primary Examiner* — Jannelle M Lebron

(57) ABSTRACT

An ink container usable with an image forming apparatus having a carriage to transport the ink container in a reciprocating motion across a substrate and an ink ejector to eject the ink onto the substrate is included. The ink container includes a chamber configured to supply ink to the ink ejector of the image forming apparatus. The ink container also includes a separation member disposed within the chamber configured to separate unwanted particles from the ink in response to the reciprocating motion of the carriage and gravity, and to direct the ink downstream to the ink ejector.

14 Claims, 8 Drawing Sheets

INK CONTAINER TO SEPARATE UNWANTED PARTICLES FROM INK

BACKGROUND

Ink containers are used to supply ink to image forming apparatus. Ink containers may be removably attached to a carriage of the image forming apparatus to move back and forth across a substrate for the ink to be ejected on. A plurality of removable ink containers may be included on the carriage in which each ink container may contain ink of a different color such as black, magenta, cyan and yellow. Some ink containers may supply ink to an ink ejector to eject the ink onto the substrate in which the ink ejector is separate from the ink container. Other ink containers may supply ink to an ink ejector which is integrated with the ink containers.

BRIEF DESCRIPTION OF THE DRAWINGS

Example non-limiting embodiments of the present general inventive concept are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

Throughout the drawings, identical reference numbers designate similar, but not necessarily identical, elements.

DETAILED DESCRIPTION

In the following detailed description, reference is made to the accompanying drawings which form a part hereof, and in which is illustrated by way of illustration of specific example embodiments in which the present general inventive concept may be practiced. It is to be understood that other example embodiments may be utilized and structural or logical changes may be made without departing from the scope of the present general inventive concept. The following detailed description, therefore, is not to be taken in a limiting sense, and the scope of the present general inventive concept is defined by the appended claims.

Ink containers usable with image forming apparatuses supply ink to ink ejectors to be ejected onto a substrate such as a print medium. The ink may contain unwanted particles such as undesired pigments that fall out of suspension therein that may negatively impact the ink container, ink ejector and other in-line components of the image forming apparatuses such as filters. Such unwanted particles may result in costly repairs and/or degradation of images formed by the ink ejected onto the substrate and/or prevent the use of a variety of pigment-based inks. Thus, removal of unwanted particles in an ink container is beneficial.

Figure 1:
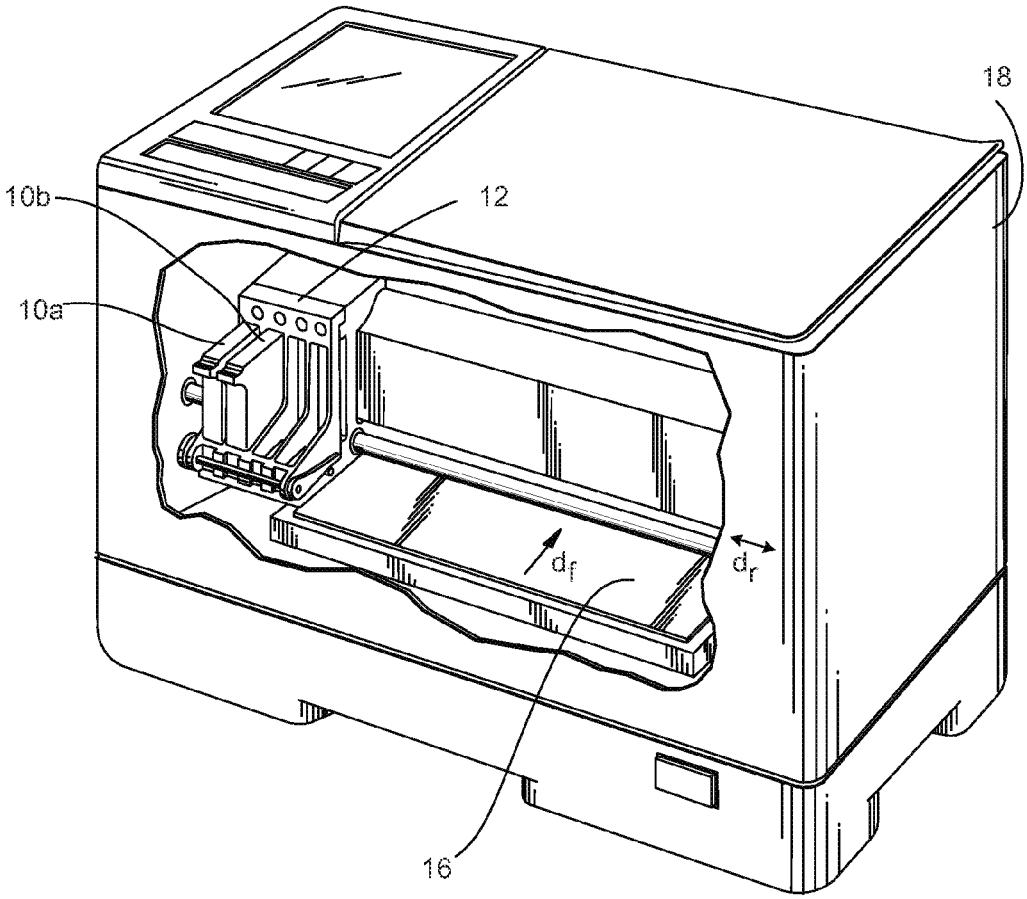
FIG. 1 is a perspective view with a cutout partially illustrating ink containers mounted on a carriage of an image forming apparatus according to an example embodiment of the present general inventive concept.

FIG. 1 is a perspective view with a cutout partially illustrating an ink container mounted on a carriage of an image forming apparatus according to an example embodiment of the present general inventive concept. Referring to FIG. 1, in an example, a plurality of ink containers 10*a* and 10*b* are removably mounted on a carriage 12 of an image forming apparatus 18. The carriage 12 moves in a reciprocating motion $d_r$, for example, in a back and forth linear motion across a substrate 16 on which ink is intended to be ejected such as to form images. The substrate 16 may move in a feeding direction $d_f$ substantially perpendicular to the reciprocating motion $d_r$. In the present example, the ink containers 10*a* and 10*b* are separate from the ink ejectors (not illustrated) such as print heads which, for example, may also be mounted on the carriage 12. In other examples, the ink ejectors 69 (FIG. 7A) may be integrated with the respective ink containers 10*a* and 10*b*. In the present example, the carriage 12 of FIG. 1 holds up to four ink containers. In other examples, the carriage 12 of FIG. 1 can hold more or less than four ink containers.

Figure 2:
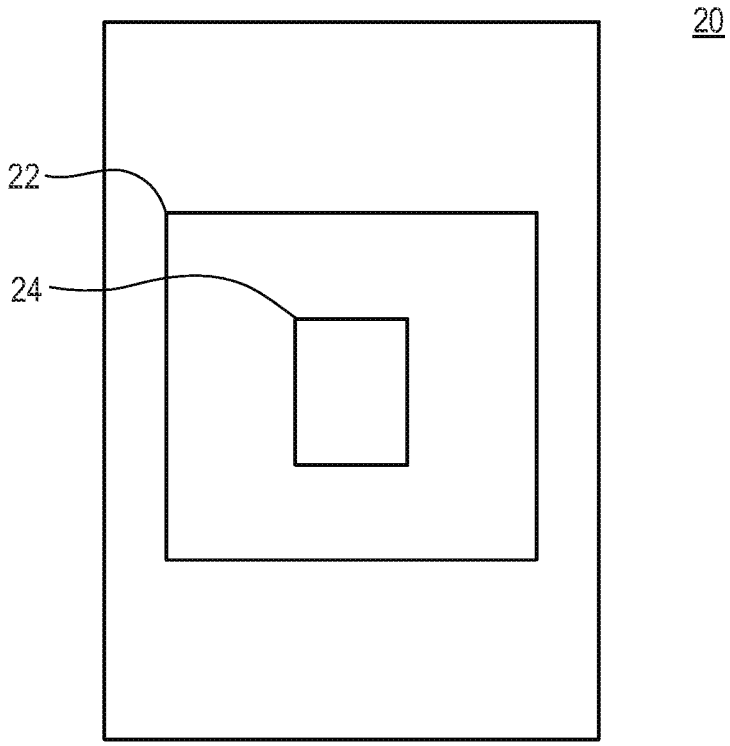
FIG. 2 is a block diagram illustrating an ink container according to an example embodiment of the present general inventive concept.

FIG. 2 is a block diagram illustrating an ink container according to an example embodiment of the present general inventive concept. Referring to FIGS. 1 and 2, in an example, an ink container 20 includes a chamber 22 that may be configured to supply ink to the ink ejector of the image forming apparatus 18. The ink container 20, for example, may correspond to one of the ink containers 10*a* and 10*b* illustrated in FIG. 1. The ink container 20 also includes a separation member 24 disposed within the chamber 22. In the present example, the separation member 24 is configured to separate unwanted particles such as pigments that fall out of suspension from the ink in response to the reciprocating motion $d_r$ of the carriage 12 and gravity, and to direct the ink downstream to the ink ejector. That is, the separation member 24 prevents unwanted particles from being supplied to the ink ejector. In the present example, the ink container 20 is usable with an image forming apparatus 18 having a carriage 12 to transport the ink container 20 in a reciprocating motion $d_r$ across a substrate 16 and an ink ejector to eject the ink onto the substrate 16.

Figure 3:
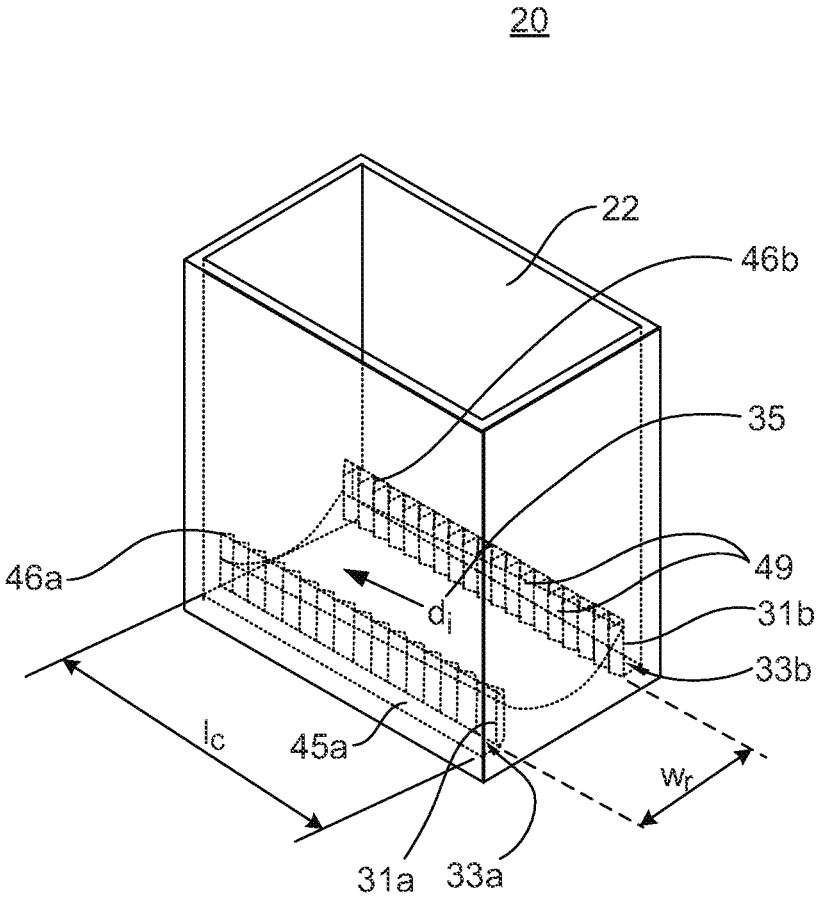
FIG. 3 is a perspective view illustrating the ink container of FIG. 2 according to an example embodiment of the present general inventive concept.

FIG. 3 is a perspective view illustrating the ink container of FIG. 2 according to an example embodiment of the present general inventive concept. Referring to FIG. 3, in the present example, the separation member 24 includes side walls 31*a* and 31*b* extending downwardly. The side walls 31*a* and 31*b*, for example, are configured to form at least a portion of trenches 33*a* and 33*b* to collect the unwanted particles, respectively. As illustrated in FIG. 3, a side wall 31*a* of the separation member 24 forms a side wall of the respective trench 33*a*. The separation member 24 also includes a ramp portion 35 disposed between the side walls 31*a* and 31*b*. The chamber 22 has a length $l_c$.

Figure 4A:
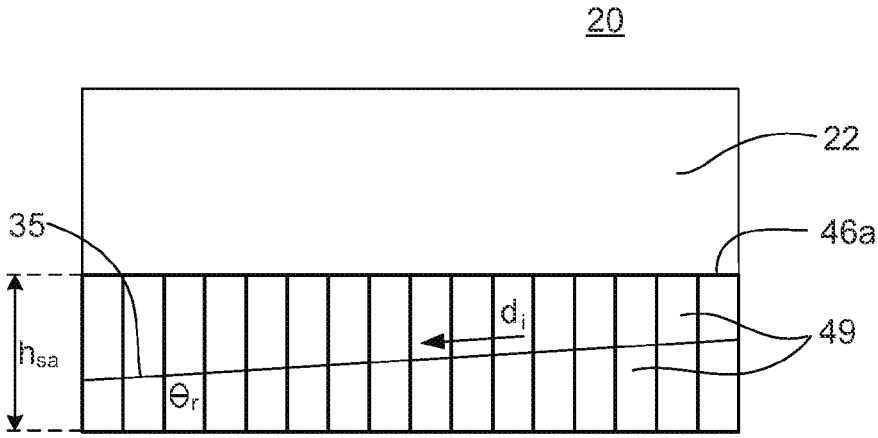
FIG. 4A is a side view of the ink container of FIG. 3 illustrating an inclined ramp portion of a separation member according to an example embodiment of the present general inventive concept.

FIG. 4A is a side view of the ink container of FIG. 3 illustrating an inclined ramp portion of a separation member according to an example embodiment of the present general inventive concept. Referring to FIGS. 1, 3 and 4A, the ramp portion 35 is configured to direct the unwanted particles to the respective trenches 33*a* and 33*b* in response to the reciprocating motion $d_r$ of the carriage 12 and the gravity, and to direct the ink downstream to the ink ejector of the image forming apparatus 18. As illustrated in FIG. 4A, the ramp portion 35 is inclined and extends across an entire length $l_c$ of the chamber 22 and descends in a downstream direction $d_i$ of the chamber 22. The ramp portion 35 forms an angle $\Theta_r$ with respect to a bottom surface of the chamber 22. In the present example, $\Theta_r$, may be in a range of 1 to 10 degrees. In another example, $\Theta_r$ may be less than 1 degree. In other examples, $\Theta_r$ may be greater than 10 degrees.

Figure 4B:
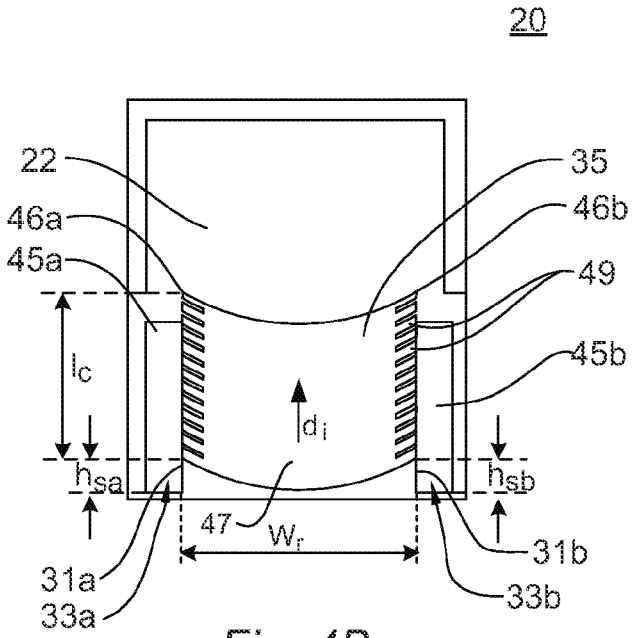
FIG. 4B is a top perspective view illustrating the ramp portion of FIG. 3 according to an example embodiment of the present general inventive concept.

Referring to FIGS. 3 and 4A, in the present example, the ramp portion 35 includes top portions 46*a* and 46*b* and a central portion 47. Each top portion 46*a* and 46*b* is disposed at an intersection of the respective side wall 31*a* and 31*b* and the ramp portion 35. The central portion 47 is disposed between the top portions 46*a* and 46*b* and is lower than the top portions 46*a* and 46*b*. As illustrated in FIGS. 3 and 4A, the side walls 31*a* and 31*b* include wicking members 49 configured to transport the ink from the respective trenches 33*a* and 33*b* to the ramp portion 35, for example, in an upward direction. The ink may move in an upward direction along the wicking members 49 through capillary forces. FIG. 40 is a cross-sectional view of a side wall of a separation member according to an example embodiment of the present general inventive concept. In the present example, the wicking members 49 may include grooved channels 49*a* and/or ribs 49*b* that extend along a respective height $h_{sa}$ and $h_{sb}$ of the side walls 31*a* and 31*b* as illustrated in FIGS. 3-4B. In other examples, $h_{sa}$ and $h_{sb}$ may not be equal to each other.

FIG. 4B is a top perspective view illustrating the ramp portion of FIG. 3 according to an example embodiment of the present general inventive concept. As illustrated in FIG. 4B, in the present example, the wicking members 49 extend onto areas of the ramp portion 35 proximate to the respective top portions 46*a* and 46*b* thereof. Thus, the ink directed out of the trenches 33*a* and 33*b* onto the ramp portion 35 may be directed towards the central portion 47 of the ramp portion 35. From the central portion 47 of the ramp portion 35, the ink may be directed downstream $d_i$ towards the ink ejector. As illustrated in FIG. 4B, in the present example, the separation member 24 may also include a pair of bottom members 45*a* and 45*b* in which each bottom member 45*a* and 45*b* is configured to extend outwardly from a lower end of the respective side wall 31*a* and 31*b* to form a bottom portion of the respective trench 33*a* and 33*b* such that the trenches 33*a* and 33*b* are disposed adjacent to the ramp portion 35 and extend along the entire length of the chamber 22. In other examples, the separation member 24 may not include a pair of bottom members 45*a* and 45*b* in which a portion of a bottom surface of the chamber 22 may form the bottom portion of the respective trench 33*a* and 33*b*.

Figure 5:
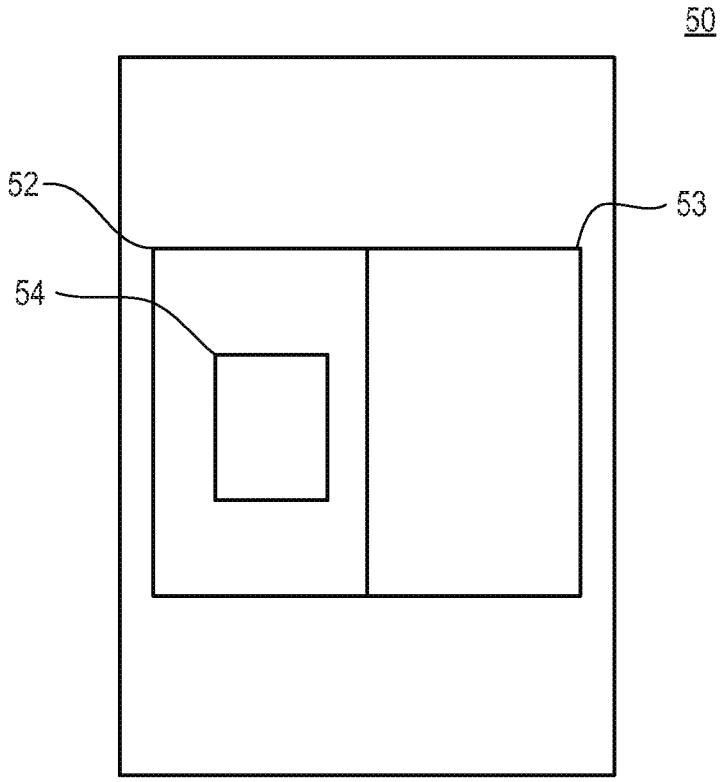
FIG. 5 is a block diagram of an ink container according to an example embodiment of the present general inventive concept.

FIG. 5 is a block diagram illustrating an ink container according to an example embodiment of the present general inventive concept. Referring to FIG. 5, in the present example, an ink container 50 includes chambers 52 and 53 in fluid communication with each other. One chamber 52 is disposed upstream from an other chamber 53. The one chamber 52 is configured to supply ink to the other chamber 53. As illustrated in FIG. 5, a separation member 54 is disposed within the one chamber 52. In the present example, the separation member 54 of FIG. 5 may be similar to the separation member 24 described and illustrated in FIGS. 2-4B. The separation member 54 illustrated in FIG. 5 is configured to separate unwanted particles from the ink in response to the reciprocating motion $d_r$ of the carriage 12 (FIG. 1) and gravity. In the present example, the ink container 50 may be usable with the carriage 12 of the image forming apparatus 18 to move the ink container 50 in the reciprocating motion $d_r$.

Figure 6:
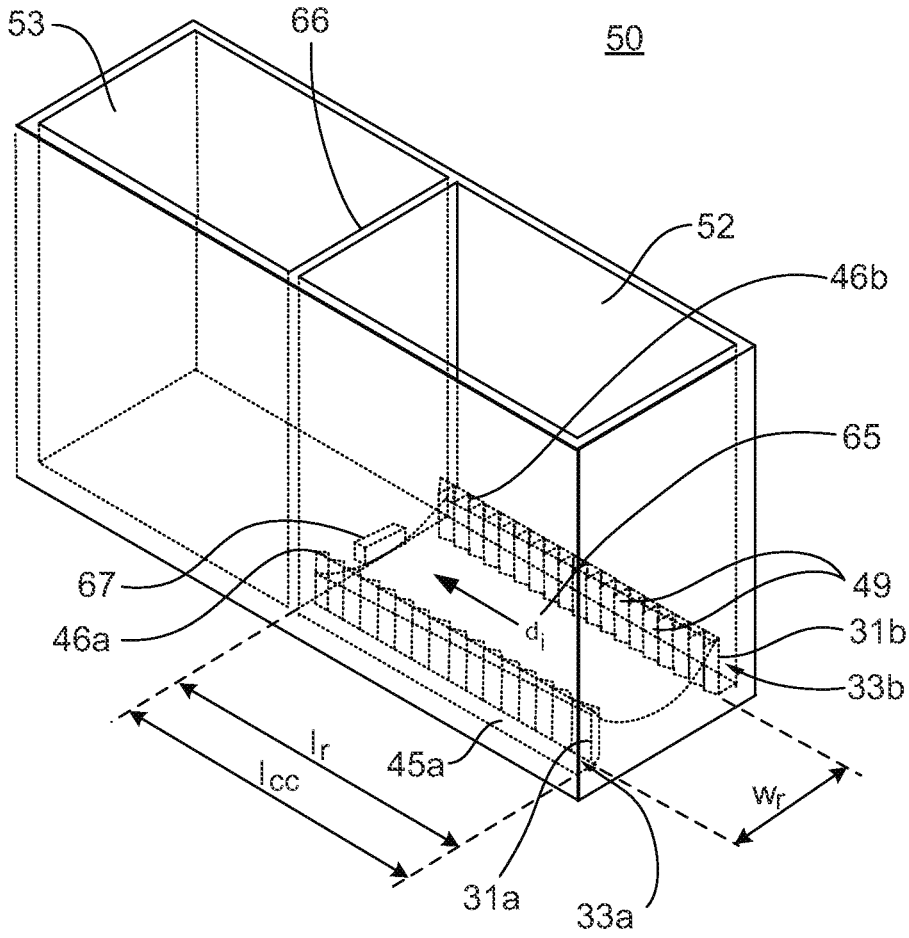
FIG. 6 is a perspective view illustrating the ink container of FIG. 5 according to an example embodiment of the present general inventive concept.
Figure 7A:
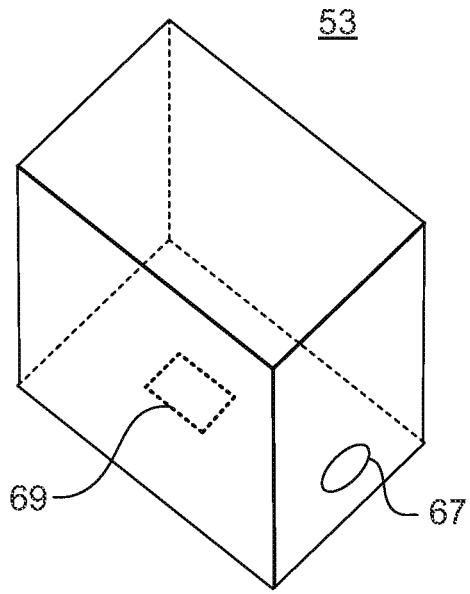
FIGS. 7A and 7B are top perspective views of other chamber of the ink container of FIG. 6 including an ink ejector and a hole, respectively, according to example embodiments of the present general inventive concept.
Figure 7B:
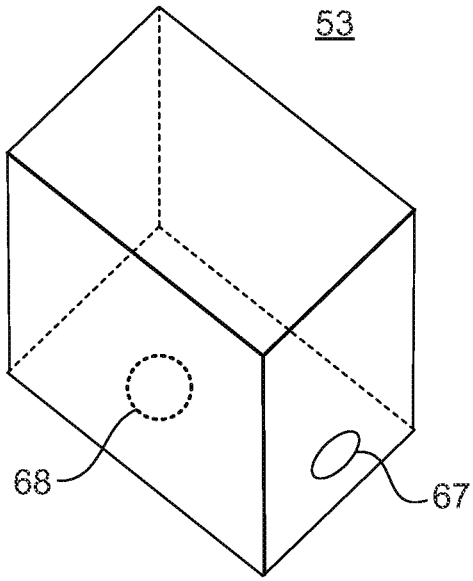

FIG. 6 is a perspective view illustrating the ink container of FIG. 5 according to an example embodiment of the present general inventive concept. Referring to FIG. 6, in the present example, a wall 66 separates the one chamber 52 from the other chamber 53. The wall 66 may include an opening 67 on a lower portion thereof to allow fluid communication between the one chamber 52 and the other chamber 53. In an example, the other chamber 53 may include an ink ejector 69 (FIG. 7A). In another example, the other chamber 53 includes a hole 68 (FIG. 7B) leading to the ink ejector (not illustrated).

Figure 8:
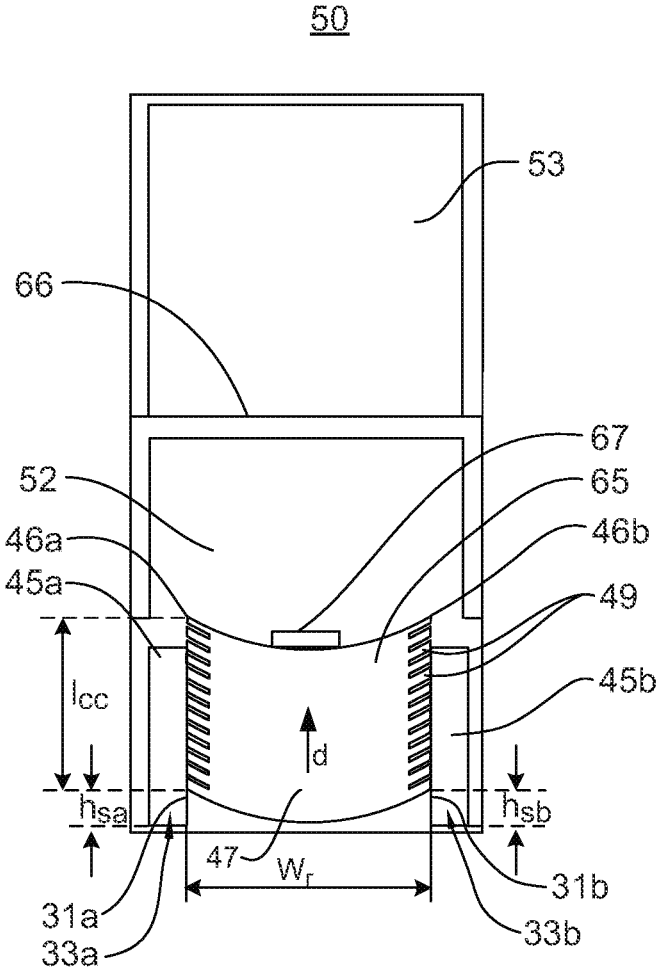
FIG. 8 is a top perspective view illustrating a ramp portion of FIG. 6 according to an example embodiment of the present general inventive concept.

Referring to FIGS. 5 and 6, the ink container 50 includes a separation member 54, for example, that may be located proximate to a bottom portion of the one chamber 52. Similar to the separation member 24 described and illustrated in FIGS. 2-4B, the separation member 54 as illustrated in FIGS. 5-6, in the present example, includes side walls 31*a* and 31*b* extending downwardly and the ramp portion 65. The side walls 31*a* and 31*b* are configured to form at least a portion of the respective trenches 33*a* and 33*b* to collect the unwanted particles, respectively. The ramp portion 65 is disposed between the side walls 31*a* and 31*b* and inclined in a lengthwise direction $l_r$ thereof. In an example, the ramp portion 65 includes a concave surface having a concavity extending across a width $w_r$ of the ramp portion 65 (FIG. 8). The ramp portion 35 is configured to direct the unwanted particles to the respective trenches 33*a* and 33*b* in response to the reciprocating motion $d_r$ of the carriage 12 and to direct the ink through the opening 67 to the other chamber 53.

Referring to FIGS. 6 and 8, in the present example, the separation member 54 includes a pair of bottom members 45*a* and 45*b* as illustrated and described with respect to the separation member 24 of FIG. 4B. Referring to FIGS. 6 and 8, each bottom member 45*a* and 45*b* is configured to extend outwardly from a lower end of the respective side wall 31*a* and 31*b* to form a bottom portion of the respective trench 33*a* and 33*b*. In an example, the trenches 33*a* and 33*b* are disposed adjacent to the ramp portion 35 and extend along the entire length $l_{cc}$ of the one chamber. In other examples, the separation member 54 may not include a pair of bottom members 45*a* and 45*b* and, thus, a portion of a bottom surface of the chamber 52 may form the bottom portion of the respective trench 33*a* and 33*b*.

Figure 4C:
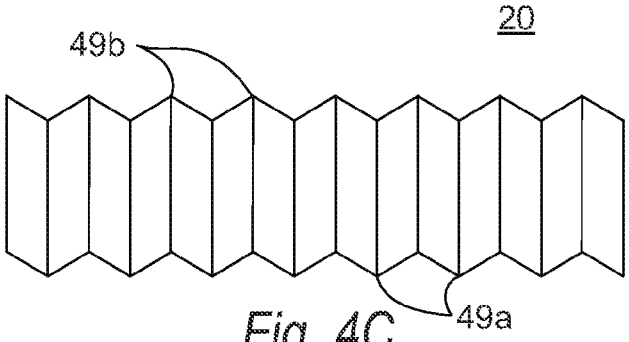
FIG. 4C is a cross-sectional view of a side wall of a separation member according to an example embodiment of the present general inventive concept.

As illustrated in FIGS. 6 and 8, the side walls 31*a* and 31*b* include wicking members 49 configured to transport the ink from the respective trenches 33*a* and 33*b* to the ramp portion 65, for example, in an upward direction. The ink may move in an upward direction along the wicking members 49 through capillary forces. In the present example, as illustrated in FIGS. 4C, 6, and 8, the wicking members 49 may include at least one of grooved channels 49*a* and ribs 49*b* that extend along a respective height $h_{sa}$ and $h_{sb}$ of the side walls 31*a* and 31*b*.

Figure 9A:
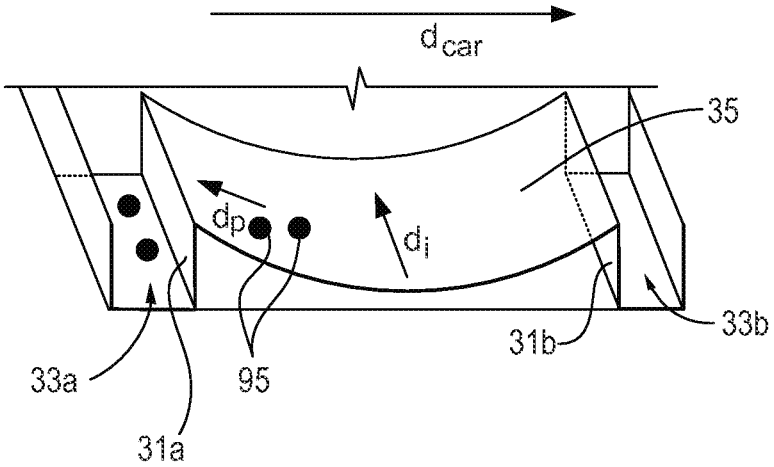
FIGS. 9A and 9B are top perspective views illustrating a portion of ink container and movement of the ink and unwanted particles in response to carriage motion according to example embodiments of the present general inventive concept.
Figure 9B:
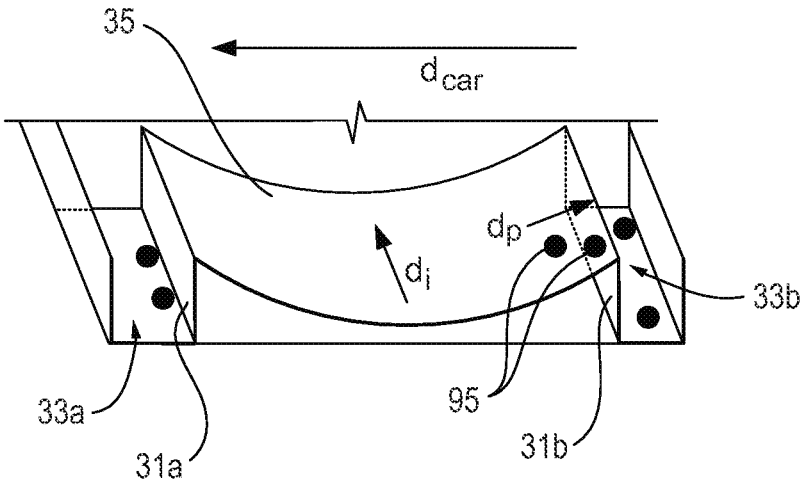

FIGS. 9A and 9B are top perspective views of a portion of ink container illustrating movement of the ink and unwanted particles in response to carriage motion according to example embodiments of the present general inventive concept. Referring to FIG. 9A, in the present example, the carriage 12 in which the respective ink container 20 and 50 is attached is moving $d_{car}$ to a right-side of the image forming apparatus 18 (FIG. 1). Unwanted particles 95, for example, drop out of suspension from the ink due to gravity and reside on the ramp portion 35 and 65. The unwanted particles 95 residing on the ramp portion 35 move opposite to a direction of acceleration of the carriage 12 due to the carriage motion $d_{car}$. That is, when the acceleration direction of the carriage 12 is to the right-side of the image forming apparatus 18, the unwanted particles residing on the ramp portion 35 move to a left-side of the image forming apparatus 18 due to kinetic energy caused by the carriage motion $d_{car}$ and into the respective trench 33*a* due to gravity. The ink in the respective trench 33*a* moves out of the trench 33*a* towards the ramp portion 35 along the wicking members 49 due to capillary forces. The unwanted particles previously collected in the opposite trench 33*b* are prevented from escaping out of the respective trench 33*b* due to the respective side wall 31*b* acting as a barrier. The ink proximate to the ramp portion 35 and 65 moves downstream due to inclination of the ramp portion 35 and 65.

Referring to FIG. 9B, in the present example, the carriage 12 in which the respective ink container 20 and 50 is attached is moving $d_{car}$ to the left-side of the image forming apparatus 18. Unwanted particles 95, for example, drop out of suspension from the ink due to gravity and reside on the ramp portion 35 and 65. The unwanted particles 95 residing on the ramp portion 35 and 65 move opposite to the direction of acceleration of the carriage 12 due to the carriage motion $d_{car}$. That is, when the acceleration direction of the carriage 12 is to the left-side of the image forming apparatus 18, the unwanted particles residing on the ramp portion 35 move to the right-side of the image forming apparatus 18 due to kinetic energy caused by the carriage motion $d_{car}$ and into the respective trench 33*b* due to gravity. The ink in the respective trench 33*b* moves out of the trench 33*b* towards the ramp portion 35 along the wicking members 49 due to capillary forces. The unwanted particles previously collected in the opposite trench 33*a* are prevented from escaping out from the respective trench 33*b* due to the respective side wall 31*a* acting as a barrier. The ink proximate to the ramp portion 35 and 65 moves downstream, in part, due to inclination of the ramp portion 35 and 65.

The present general inventive concept has been described using non-limiting detailed descriptions of example embodiments thereof that are provided by way of example and are not intended to limit the scope of the present general inventive concept. It should be understood that features and/or operations described with respect to one example embodiment may be used with other example embodiments and that not all example embodiments of the present general inventive concept have all of the features and/or operations illustrated in a particular figure or described with respect to one of the embodiments. Variations of example embodiments described will occur to persons of the art. Furthermore, the terms "comprise," "include," "have" and their conjugates, shall mean, when used in the disclosure and/or claims, "including but not necessarily limited to."

It is noted that some of the above described example embodiments may describe the best mode contemplated by the inventors and therefore may include structure, acts or details of structures and acts that may not be essential to the present general inventive concept and which are described as examples. Structure and acts described herein are replaceable by equivalents, which perform the same function, even if the structure or acts are different, as known in the art. Therefore, the scope of the present general inventive concept is limited only by the elements and limitations as used in the claims.

What is claimed is:

1. An ink container usable with an image forming apparatus having a carriage to transport the ink container in a reciprocating motion across a substrate and an ink ejector to eject the ink onto the substrate, the ink container comprising:

a chamber configured to supply ink to the ink ejector of the image forming apparatus; and a separation member disposed within the chamber and including a plurality of side walls extending downwardly and a ramp portion disposed between the side walls, the separation member configured to separate unwanted particles from the ink in response to the reciprocating motion of the carriage and gravity, and to direct the ink downstream to the ink ejector;

the plurality of side walls configured to form at least a portion of trenches to collect the unwanted particles, respectively; and the ramp portion configured to direct the unwanted particles to the respective trenches in response to the reciprocating motion of the carriage and the gravity, and to direct the ink downstream to the ink ejector of the image forming apparatus.

2. The ink container according to claim 1, wherein the ramp portion is inclined and extends across an entire length of the chamber in a descending manner in a downstream direction.

3. The ink container according to claim 2, wherein the ramp portion comprises:

a plurality of top portions, each top portion is disposed at an intersection of the respective side wall and the ramp portion; and a central portion disposed between the plurality of top portions such that the central portion is lower than the plurality of top portions.

4. The ink container according to claim 3, wherein the plurality of side walls comprises: a plurality of wicking members configured to transport the ink from the respective trenches to the ramp portion.

5. The ink container according to claim 4, wherein the plurality of wicking members comprises:

at least one of grooved channels and ribs extending along a respective height of the plurality of side walls.

6. The ink container according to claim 5, wherein the plurality of wicking members extends onto areas of the ramp portion proximate to the respective top portions thereof.

7. The ink container according to claim 6, wherein the separation member further comprises:

a pair of bottom members, each bottom member configured to extend outwardly from a lower end of the respective side wall to form a bottom portion of the respective trench such that the trenches are disposed adjacent to the ramp portion and extend along the entire length of the chamber.

8. An ink container usable with a carriage of an image forming apparatus to move the ink container in a reciprocating motion, the ink container comprising:

a plurality of chambers in fluid communication with each other, one chamber is disposed upstream from an other chamber and is configured to supply ink to the other chamber; and a separation member disposed within the one chamber proximate to a bottom portion thereof, the separation member including a ramp portion extending across a length of the chamber in an inclined and descending manner in a downstream direction; and wherein the separation member is configured to separate unwanted particles from the ink in response to the reciprocating motion of the carriage and gravity.

9. The ink container according to claim 8, further comprising:

a wall separating the one chamber from the other chamber, the wall having an opening on a lower portion thereof to allow fluid communication between the one chamber and the other chamber; and wherein the other chamber comprises an ink ejector.

10. The ink container according to claim 9, wherein the separation member comprises:

a plurality of side walls extending downwardly, the plurality of side walls configured to form at least a portion of trenches to collect the unwanted particles, respectively; and the ramp portion disposed between the side walls and inclined in a lengthwise direction thereof, the ramp portion configured to direct the unwanted particles to the respective trenches in response to the reciprocating motion of the carriage and to direct the ink through the opening to the other chamber.

11. The ink container according to claim 10, wherein the plurality of side walls comprises:

a plurality of wicking members configured to transport the ink upwardly from the respective trenches to the ramp portion.

12. The ink container according to claim 11, wherein the plurality of wicking members comprises:

at least one of grooved channels and ribs extending along a respective height of the plurality of side walls.

13. The ink container according to claim 12, wherein the separation member further comprises:

a pair of bottom members, each bottom member configured to extend outwardly from a lower end of the respective side wall to form a bottom portion of the respective trench such that the trenches are disposed adjacent to the ramp portion and extend along the entire length of the one chamber.

14. The ink container according to claim 13, wherein the ramp portion further comprises:

a concave surface having a concavity extending across a width of the ramp portion.

* * * * *

UNITED STATES PATENT AND TRADEMARK OFFICE

CERTIFICATE OF CORRECTION

PATENT NO. : 8,556,397 B2
APPLICATION NO. : 13/259690
DATED : October 15, 2013
INVENTOR(S) : Jon Rittgers et al.

It is certified that error appears in the above-identified patent and that said Letters Patent is hereby corrected as shown below:

On the Title Page, Item (73), Assignee, in column 1, line 2, delete "L. P.," and insert -- L.P., --, therefor.

Signed and Sealed this
Third Day of June, 2014

Michelle K. Lee

Michelle K. Lee
*Deputy Director of the United States Patent and Trademark Office*